United States Patent [19]

Johnson

[11] 3,932,912

[45] Jan. 20, 1976

[54] VACUUM CLEANER

[75] Inventor: Robert E. Johnson, St. Paul, Minn.

[73] Assignee: Whirlpool Corporation, Benton Harbor, Mich.

[22] Filed: Feb. 15, 1974

[21] Appl. No.: 442,799

[52] U.S. Cl. ..... 15/410
[51] Int. Cl.[2] ..... A47L 9/32
[58] Field of Search ..... 15/361, 410

[56] References Cited

UNITED STATES PATENTS

| | | | |
|---|---|---|---|
| 1,953,944 | 4/1934 | Becker | 15/410 X |
| 1,968,238 | 7/1934 | Zabriskie | 15/410 |
| 3,031,710 | 5/1962 | Huening | 15/410 X |
| 3,683,449 | 8/1972 | Nordeen | 15/410 |

*Primary Examiner*—Edward L. Roberts
*Assistant Examiner*—C. K. Moore
*Attorney, Agent, or Firm*—Hofgren, Wegner, Allen, Stellman & McCord

[57] ABSTRACT

A vacuum cleaner having a selectively positionable stop for retaining the handle structure in an intermediate position between an upright storage position and a lowered, operating position. The positionable stop may be carried on a pivoted casing associated with the handle structure and a cooperating shoulder element may be movably carried on the floor cleaning unit for engaging the intermediate stop. The shoulder element may be movably carried on the cleaning unit so as to pass the intermediate stop when desired.

11 Claims, 7 Drawing Figures

Fig. 1.
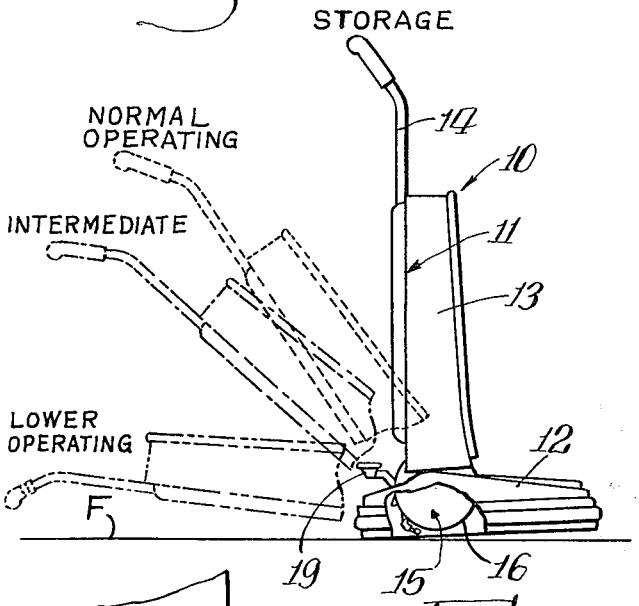
Fig. 2.
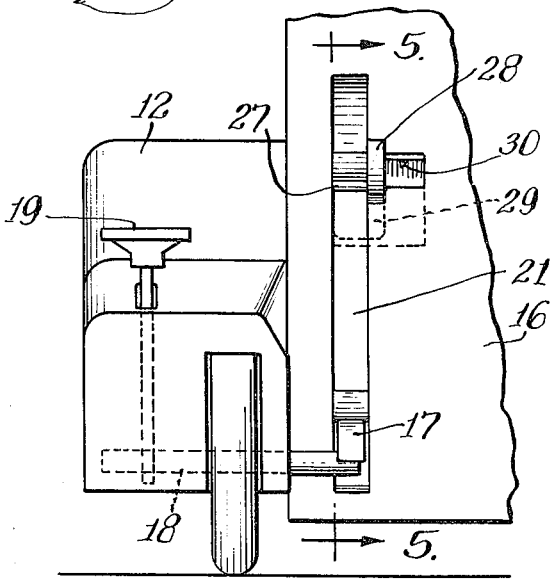
Fig. 3.
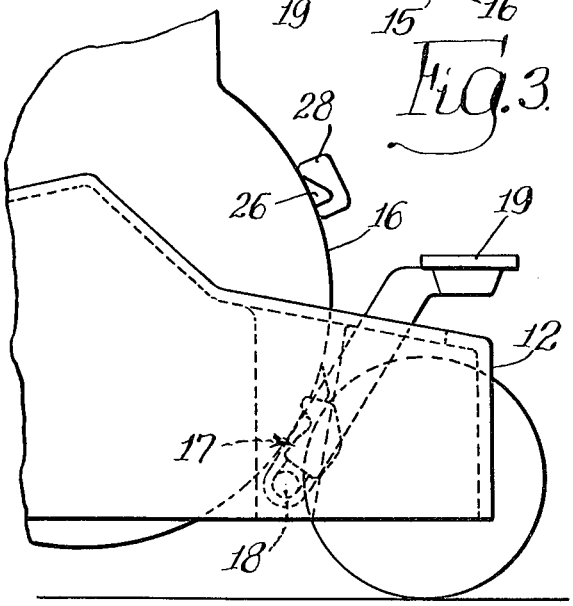
Fig. 5.
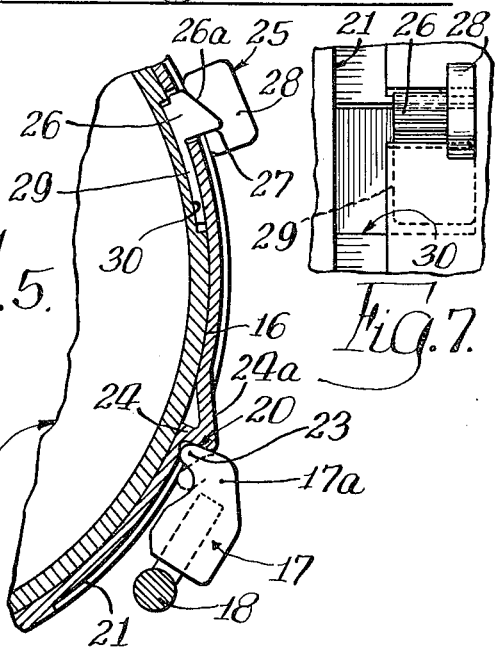
Fig. 7.
Fig. 4.
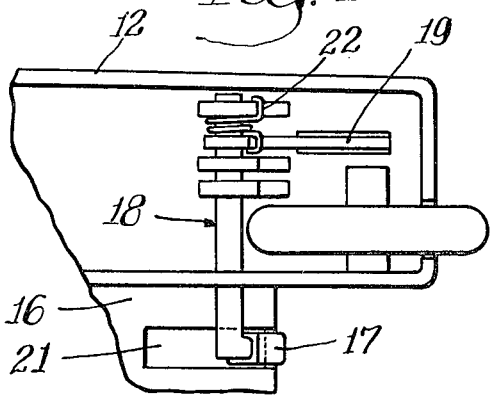
Fig. 6.
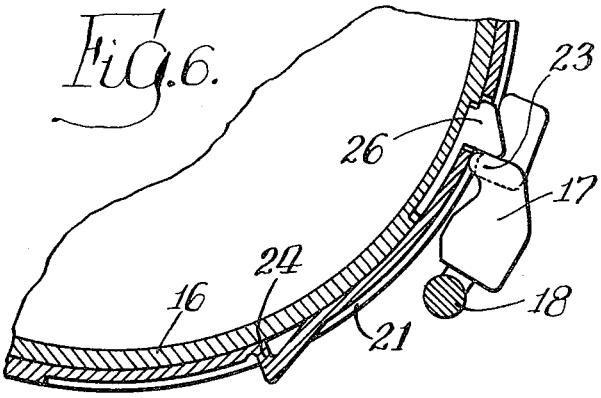

VACUUM CLEANER

BACKGROUND OF THE INVENTION

1. Field of the Invention

This invention relates to vacuum cleaners, and in particular, to means for controlling the handle disposition of upright vacuum cleaners.

2. Description of the Prior Art

An improved upright vacuum cleaner structure is shown in U.S. Pat. No. 3,683,449 of Erwin E. Nordeen, owned by the assignee hereof. In the Nordeen vacuum cleaner structure, cooperating catch means are provided on the floor contacting cleaning unit and on the handle structure to retain the handle in an upright storage position. Means are provided for releasing the engagement of the catch means to permit the handle to be swung to an operating position. At least one of the catch means disclosed therein is yieldable to permit forcible disengagement to prevent damage to the vacuum cleaner parts.

As indicated in the Nordeen patent, the following additional U.S. Pat. Nos. are pertinent to such vacuum cleaner structure:

| | |
|---|---|
| 2,684,271 | Brace |
| 2,881,465 | Duff |
| 3,031,710 | Huening, Jr. |
| 3,199,138 | Nordeen |
| 3,512,207 | Ettridge |

In the Ettridge patent indicated above, a suction cleaner is shown wherein a cam is provided for cooperation with a T-shaped member in lifting the front end of the casing.

Another form of vacuum cleaner structure is shown in U.S. Pat. No. 1,958,602 of George W. Allen et al. wherein a latching device is provided having a detent which selectively engages or escapes engagement with a hook member as a function of the speed with which the handle is moved from one position to another.

SUMMARY OF THE INVENTION

The present invention comprehends an improved vacuum cleaner construction generally of the type disclosed in the above-identified Nordeen U.S. Pat. No. 3,683,449, but having improved means for providing an intermediate retained positioning of the handle structure.

More specifically, the present invention comprehends providing a vacuum cleaner with a handle structure which is swingably mounted to a cleaning unit portion and which is selectively retained in an upright storage position and in an intermediate position between an upper and a lower operating position.

In the illustrated embodiment, the means for providing the intermediate position retention includes cooperating means on the cleaning unit and handle structure including means defining stop shoulders and manually operable means for selectively positioning at least one of the stop shoulders on its associated element.

More specifically, the invention comprehends providing in such a vacuum cleaner a cleaning unit movable over a floor for cleaning thereof, a handle structure for moving the cleaning unit including a handle and means swingably mounted to the cleaning unit for movement of the handle structure between an upper and a lower operating position, and cooperating means on the cleaning unit and handle structure for selectively retaining the handle in an intermediate position intermediate the upper and lower operating positions including first stop shoulder means defining a first stop shoulder on the cleaning unit and second stop shoulder means defining a second stop shoulder on the handle structure and manually operable means for selectively fixedly positioning the second stop shoulder in a retaining position, the first stop shoulder being disposed in the path of movement of the second stop shoulder in the retaining position.

The handle structure may include a casing provided with a peripheral slot with the second stop shoulder means being mounted adjacent the slot. The first stop shoulder comprises a deflectible finger mounted on the cleaning unit for preventing breakage of the parts in the event of an abnormally high force applied between the cleaning unit and the handle structure tending to force the stop shoulder means past each other.

The second stop shoulder means may comprise an element slidably mounted on the casing having a manipulating handle for selectively moving the stop shoulder into the peripheral slot in the casing in which the distal end of the finger member defining the first stop shoulder means rides.

The invention comprehends movably mounting the first stop shoulder means to the cleaning unit so as to permit selective disposition of the first stop shoulder means out of the path of movement of the second stop shoulder when it is disposed in the slot to provide further control of the manipulation of the handle structure. Thus, if the user finds that the intermediate position retention means is not normally required in the use of the vacuum cleaner, the second stop shoulder means may be retained in a retracted disposition permitting the handle structure to be swung freely between the upper operating position and the lower operating position. Where an intermediate stop position is desired, the intermediate stop means may be suitably positioned to provide this function with the first stop means on the cleaning unit being operated in the conventional manner as by a foot pedal to bypass the second stop shoulder means when it is desired to lower the handle structure to the lower operating position, thereby eliminating the need to reposition the intermediate stop means on the casing.

Thus, the handle structure positioning control means of the present invention is extremely simple and economical of construction while yet providing the improved functioning discussed above.

BRIEF DESCRIPTION OF THE DRAWING

Other features and advantages of the invention will be apparent from the following description taken in connection with the accompanying drawing wherein:

FIG. 1 is a right side elevation partly broken away of a vacuum cleaner embodying the invention with the handle structure thereof shown in a normal operating position, an intermediate stop position and a lower operating position in broken lines;

FIG. 2 is a fragmentary enlarged rear elevation thereof;

FIG. 3 is a fragmentary enlarged left side elevation thereof;

FIG. 4 is a fragmentary bottom plan view thereof;

FIG. 5 is a fragmentary vertical section taken substantially along the line 5—5 of FIG. 2;

FIG. 6 is a fragmentary vertical elevation illustrating the arrangement of the stop shoulder means retaining the handle structure in an intermediate position; and FIG. 7 is a fragmentary rear elevation illustrating the arrangement of the stop shoulder means on the handle structure in a retracted position.

DESCRIPTION OF THE PREFERRED EMBODIMENT

In the exemplary embodiment of the invention as disclosed in the drawing, a vacuum cleaner generally designated 10 is shown to comprise an upright vacuum cleaner having a handle structure 11 and a floor contacting cleaning unit 12 adapted to be moved over a floor F to be cleaned. The handle structure includes a bag housing 13, a handle 14, a lower suction unit 15 defining a casing 16 rotatably mounted to the cleaning unit 12 whereby the handle structure 11 may be swung between an upright storage position, as shown in full lines in FIG. 1, and normal and lower operating positions shown in broken lines therein.

The present invention comprehends an improved means for selectively retaining the handle structure in an intermediate position shown in dotted lines in FIG. 1, intermediate the normal operating position and the lower operating position.

More specifically as shown in FIGS. 2, 3 and 4, a first stop shoulder means 17 is mounted to cleaning unit 12 by a pivot support 18 having a foot pedal 19 connected thereto for selectively swinging the first stop shoulder means toward and from the casing 16. First stop shoulder means 17 defines a finger element 17*a* having a deflectible nose portion 23 which is disposed in a circumferential slot 21 of the cylindrical casing 16 by the biasing action of a spring 22. The deflectible nose portion 23 defines a first stop shoulder 20. In the illustrated embodiment, the finger element is formed of a synthetic rubber-like material, one example of which is flexible polyurethane.

Casing 16 defines a fixed stop element 24 adapted to be engaged by the stop shoulder 20 when handle structure 11 is in the upright storage position, as shown in FIG. 5. To release the handle structure from the storage position, the operator depresses foot pedal 19 to swing nose portion 23 free of stop element 24 and thereby permit clockwise movement (as seen in FIG. 5) of the casing and associated handle structure.

As indicated above, the present invention comprehends the provision of an intermediate stop structure generally designated 25 for selectively retaining the handle structure in an intermediate position. Intermediate stop structure 25 includes a second stop shoulder means 26 defining a second stop shoulder 27, a handle portion 28 and a slide base portion 29. Slide base portion 29 is received in a suitable slot 30 in casing 16 extending perpendicularly from slot 21 to permit selective disposition of the stop shoulder 27 in the slot 21, as shown in FIG. 2, or retracted from the slot, as shown in FIG. 7. The selective dispositioning is effected by suitable manipulation of handle 28.

Thus, as shown in FIG. 6, after depressing pedal 19 to allow the handle structure to swing downwardly from the storage position through the normal operating position with the second stop shoulder means 26 in the slot 21, first stop shoulder means 17 limits the swinging movement to the intermediate position shown in FIG. 6 as long as foot pedal 19 is not again depressed to remove the nose portion 23 from the slot 21.

When it is desired to swing the handle structure 11 further downwardly to the lower operating position of FIG. 1, the user need merely depress the foot pedal 19 to swing the first stop shoulder finger means 17 clockwise about the axis of pivot support 18 to clear the second stop shoulder means 26. As shown in FIGS. 5 and 6, element 24 and means 26 have respective surfaces 24*a* and 26*a* which allow unrestricted movement of the handle from the lower operating position to the storage position of FIG. 1 by allowing nose portion 23 of shoulder means 17 to easily pass thereover.

Where the normal use of the vacuum cleaner does not require the intermediate stop position retention, the user may maintain the second stop shoulder means in the retracted position of FIG. 7 so that release of the first stop shoulder means 17 from the stop element 24 on casing 16 permits uninterrupted swinging of the handle structure from the upper operating position of FIG. 1 to the lower operating position thereof without further manipulation of the pedal 19. Thus, the present invention provides a facilitated control of the arrangement of the handle structure for facilitated use of vacuum cleaner 10. The deflectible nose portion 23 of first stop shoulder means 17 further prevents damage to the second stop shoulder means 26 in the event of the application of an abnormal high force tending to urge the stop shoulder means past each other from the position of FIG. 6, thus further preventing damage to the vacuum cleaner parts.

The foregoing disclosure of specific embodiments is illustrative of the broad inventive concepts comprehended by the invention.

Having described the invention, the embodiments of the invention in which an exclusive property or privilege is claimed are defined as follows:

1. A vacuum cleaner comprising: a cleaning unit movable over a floor for cleaning thereof; a handle structure for moving said cleaning unit including a handle and means swingably mounted to said cleaning unit for movement of said handle between an upper operating position and a lower operating position; and cooperating means on said cleaning unit and handle structure for selectively retaining the handle in an intermediate position intermediate said upper and lower operating positions including first stop shoulder means defining a first stop shoulder on said cleaning unit, and second stop shoulder means defining a second stop shoulder on said handle structure, and manually operable means for selectively fixedly positioning said second stop shoulder on said handle in a retaining position or in a retracted position, said first stop shoulder being disposed in the path of movement of said second stop shoulder when said second stop shoulder is selectively disposed in the retaining position while permitting a preselected limited movement of said handle relative to said cleaning unit in said upper operating position, said first stop shoulder being disposed out of the path of movement of said second stop shoulder when said second stop shoulder is selectively disposed in the retracted position to permit said handle to be brought to said lower operating position.

2. The vacuum cleaner of claim 1 wherein said cooperating means includes means slidably mounting said second stop shoulder on said handle structure for allowing movement of said second stop shoulder from said retaining position to the retracted position, whereby said retracted positioning of said second stop shoulder allows unrestricted movement of said handle structure between said upper and lower operating positions.

3. The vacuum cleaner of claim 2 wherein said manually operable means includes a manipulating handle.

4. A vacuum cleaner comprising: a cleaning unit movable over a floor for cleaning thereof; a handle structure for moving said cleaning unit including a handle and means swingably mounted to said cleaning unit for movement of said handle between an upper operating position and a lower operating position; and cooperating means on said cleaning unit and handle structure for selectively retaining the handle in an intermediate position intermediate said upper and lower operating positions including first stop shoulder means defining a first stop shoulder on said cleaning unit and second stop shoulder means defining a second stop shoulder on said handle structure, and manually operable means for selectively fixedly positioning said second stop shoulder in a retaining position, said first stop shoulder being disposed in the path of movement of said second stop shoulder in the retaining position, said cooperating means including means for movably mounting said first stop shoulder means in said cleaning unit, and means for selectively moving said first stop shoulder means to clear said second stop shoulder in said retaining position.

5. The vacuum cleaner of claim 1 wherein at least one of said first and second stop shoulders is deflectible to permit movement of said stop shoulders past each other notwithstanding the disposition of said first stop shoulder in said path of movement of said second stop shoulder in the event of an abnormally high force applied between said cleaning unit and handle structure tending to force said stop shoulders past each other.

6. A vacuum cleaner comprising: a cleaning unit movable over a floor for cleaning thereof; a handle structure for moving said cleaning unit including a handle, and a suction unit casing swingably mounted to said cleaning unit for movement of said handle between an upper operating position and a lower operating position; cooperating means on said cleaning unit and casing for selectively retaining the handle in an intermediate position intermediate said upper and lower operating positions including first stop shoulder means on said cleaning unit and second stop shoulder means on said casing, said second stop shoulder means defining manually operable means for selectively fixedly positioning said second stop shoulder means in a retaining position or in a retracted position, said first stop shoulder means being disposed in the path of movement of said second stop shoulder means when said second stop shoulder means is disposed in the retaining position; and means for selectively repositioning said first stop shoulder means on said cleaning unit to permit said first stop shoulder means to clear said second stop shoulder means notwithstanding the disposition of said second stop shoulder means in said retaining position.

7. The vacuum cleaner of claim 6 wherein said second stop shoulder means comprises means slidably mounted to said casing.

8. A vacuum cleaner comprising: a cleaning unit movable over a floor for cleaning thereof; a handle structure for moving said cleaning unit including a handle, and a suction unit casing swingably mounted to said cleaning unit for movement of said handle between an upper operating position and a lower operating position; and cooperating means on said cleaning unit and casing for selectively retaining the handle in an intermediate position intermediate said upper and lower operating positions including first stop shoulder means on said cleaning unit and second stop shoulder means on said casing, said second stop shoulder means defining manually operable means for selectively fixedly positioning said second stop shoulder means in a retaining position, said first stop shoulder means being disposed in the path of movement of said second stop shoulder means in the retaining position, said first stop shoulder means including a finger portion swingably mounted to said cleaning unit.

9. The vacuum cleaner of claim 8 wherein said casing defines a slot, said finger portion moving in said slot, and said manually operable means includes means for selectively moving said second stop shoulder means into said slot to be engaged by said finger portion of said first stop shoulder means.

10. A vacuum cleaner comprising: a cleaning unit movable over a floor for cleaning thereof; a handle structure for moving said cleaning unit including a handle, and a suction unit casing swingably mounted to said cleaning unit for movement of said handle between an upper operating position and a lower operating position; and cooperating means on said cleaning unit and casing for selectively retaining the handle in an intermediate position intermediate said upper and lower operating positions including first stop shoulder means on said cleaning unit and second stop shoulder means on said casing, said second stop shoulder means defining manually operable means for selectively fixedly positioning said second stop shoulder means in a retaining position, said first stop shoulder means being disposed in the path of movement of said second stop shoulder means in the retaining position, said casing defining a slot, said first stop shoulder means moving in said slot, said manually operable means including means for selectively moving said second stop shoulder means into said slot perpendicularly to the longitudinal extent of said slot to be engaged by said first stop shoulder means.

11. A vacuum cleaner comprising: a cleaning unit movable over a floor for cleaning thereof; a handle structure for moving said cleaning unit including a handle, and a suction unit casing swingably mounted to said cleaning unit for movement of said handle between an upper operating position and a lower operating position; and cooperating means on said cleaning unit and casing for selectively retaining the handle in an intermediate position intermediate said upper and lower operating positions including first stop shoulder means on said cleaning unit and second stop shoulder means on said casing, said second stop shoulder means defining manually operable means for selectively fixedly positioning said second stop shoulder means in a retaining position, said first stop shoulder means being disposed in the path of movement of said second stop shoulder means in the retaining position, said casing defining a slot, said first stop shoulder means moving in said slot, said manually operable means including means for selectively moving said second stop shoulder means into said slot to be engaged by said first stop shoulder means, and said vacuum cleaner further including means for selectively moving said first stop shoulder means out of said slot to bypass said second stop shoulder means when desired notwithstanding the selective positioning of said second stop shoulder means in said slot.

* * * * *